United States Patent [19]

Pappas

[11] 4,090,685

[45] May 23, 1978

[54] GRADE CROSSING ASSEMBLY

[75] Inventor: Spiro J. Pappas, Verona, Pa.

[73] Assignee: Westinghouse Air Brake Company, Swissvale, Pa.

[21] Appl. No.: 770,523

[22] Filed: Feb. 22, 1977

[51] Int. Cl.[2] ..... B61L 29/08

[52] U.S. Cl. ..... 246/125; 49/140; 246/489; 340/47

[58] Field of Search ..... 246/125, 130, 261, 272, 246/393, 406, 489; 340/47, 49; 318/138; 73/139; 49/139, 140, 141

[56] References Cited

U.S. PATENT DOCUMENTS

| | | | |
|---|---|---|---|
| 1,243,056 | 10/1917 | Fowler | 49/140 |
| 2,295,419 | 9/1942 | Miskelly | 246/125 |
| 2,488,313 | 11/1949 | Miskelly | 246/125 |
| 2,621,544 | 12/1952 | Rossmann | 49/140 |
| 3,038,991 | 6/1962 | Swanton | 246/125 |
| 3,394,498 | 7/1968 | Reinitz | 49/141 |
| 3,932,793 | 1/1976 | Müller | 318/138 |
| 4,006,629 | 2/1977 | Barrett | 73/139 |

*Primary Examiner*—Trygve M. Blix
*Assistant Examiner*—Reinhard J. Eisenzopf
*Attorney, Agent, or Firm*—J. B. Sotak; R. W. McIntire, Jr.

[57] ABSTRACT

This disclosure relates to a railroad-highway crossing gate and signal arrangement having an elongated aluminum gate arm movable between a vertical clear position and a horizontal traffic blocking position. The elongated aluminum gate arm is attached by a breakaway connector to a gate arm bracket which is connected to one end of a pair of gate arm support members. A pair of adjustable counterweights are securely attached to the other end of the gate arm support members. A power operating mechanism including a permanent magnet d.c. motor and a gear train rotatably drives an output shaft which has its respective ends attached to the pair of gate arm support members for moving the aluminum gate arm between its horizontal and vertical positions. The d.c. motor is provided with at least one shaft extension portion for receiving ratchet wrenches for manually moving the gate between its clear and blocking positions and for receiving a torque measuring device for determining the torque that is required to lift the gate arm from its horizontal position to its vertical position and for establishing torque that freely moves the gate arm from its vertical position toward its horizontal position.

14 Claims, 4 Drawing Figures

GRADE CROSSING ASSEMBLY

FIELD OF THE INVENTION

This invention relates to a railroad-highway grade crossing gate and signal assembly and, more particularly, to a traffic control gate having an elongated lightweight gate arm movable between a vertical clear position and a horizontal traffic obstructing position and including a gate mechanism having a permanent magnet d.c. motor and gear train for rotating an output shaft which drives gate arm supports and bracket which include a breakaway connector to allow the elongated gate arm to be released when it is struck by a motor vehicle, and having at least one end of the output shaft of the permanent magnet d.c. motor adapted to receive a ratchet wrench for permitting manual rotation of the output shaft and to accommodate a torque wrench for measuring the lifting torque when the elongated gate arm is in its horizontal obstructing position as well as for measuring the free moving downward torque when the elongated gate arm is in its vertical clear position.

BACKGROUND OF THE INVENTION

In order to afford maximum protection to vehicular traffic as well as to pedestrians at railroad and highway grade crossings, it is essential to provide suitable warning signals, both visual and audible, when a train is approaching the crossing. In addition to the flashing lights and clanging bell, a dangerous and/or heavily traveled intersection should be supplemented by a highway crossing gate assembly for more adaptly protecting the general public and, particularly, motorists and passengers. In the past, grade crossing gates were initially expensive to install and were subsequently costly to maintain due to their heavy and bulky construction. Prior crossing gate installations utilizing wooden or fiberglass arms normally required two or more maintainers to replace the heavy and cumbersome arm when it was run through and/or damaged by a motor vehicle. When the heavy wooden gate arm is broken, the counterweights unbalance the supporting arms and brackets and cause the output shaft to rapidly rotate to its vertical clear position. Previous types of highway crossing gate mechanisms required ancillary means, such as, a centrifugal coupler or dampening brake, in order to prevent the gate arm counterweights from dropping suddenly and causing damage to the operating mechanism in the event that the gate arm was broken while it was in its lowered or traffic blocking position. Further, it will be appreciated that when the gate arm is broken, the counterweights cause the mechanism to rotate toward its vertical position so that the support arms and bracket are pointed skyward so that the gate receiving end rotates out of the normal reach of the maintainer and it becomes extremely difficult, if not impossible, to replace the arm in this position. In many instances, the counterweights, which could amount to as much as 400 pounds or more, had to be removed from the gate supports so that the mechanism could be rotated to its horizontal position before the broken wooden gate could be replaced and placed in working order. A further disadvantage of previous highway crossing gates involves the awkward manner in measuring the dropping and lifting torques on the gate arm. It was common practice, after the gate arm is mounted to the gate supports, for a maintainer to employ a fish or spring scale and attach it to a given point on the gate arm. When the gate arm is in its lowered or traffic obstructing position, the maintainer would hold the free end of the fish scale and would pull vertically upward until the gate arm would begin to lift. He would then note the reading on the fish scale and multiply it by the moment arm to obtain the torque in footpounds. In order to obtain the free moving downward torque, when the gate arm is in its upper or clear position, the maintainer first has to set up a ladder against the supporting mast, and after climbing the ladder, he would attach the fish scale to a given point along the length of the gate arm. While the free end of the fish scale would be held by one maintainer, another maintainer would deenergize the hold clear device so that the gate arm was free to move toward its zero or horizontal position under the force of gravity. The downward movement of the gate arm exerts a force on the fish scale which when multiplied by the movement arm signifies the torque in foot-pounds. It will be appreciated that the lifting and downward torques could be varied by shifting the counterweights or by increasing or descreasing their mass until the desired torque was obtained by trial and error.

OBJECTS AND SUMMARY OF THE INVENTION

Accordingly, it is an object of this invention to provide a new and improved railroad-highway crossing gate assembly which permits quick and easy torque measurements and allows one-man arm replacement.

Another object of this invention is to provide a unique grade crossing gate wherein a torque wrench is fitted onto the shaft of the electric motor of the operating mechanism for measuring the lifting and free moving downward torques.

A further object of this invention is to provide a unique grade crossing gate wherein the gate may be manually moved between the vertical clear position and the horizontal obstructing position when an arm has been knocked off by attaching a ratchet wrench to an extension portion formed on the shaft of a drive motor.

Yet another object of this invention is to provide an improved highway crossing gate assembly having an operating mechanism including a permanent magnet d.c. motor and a gear train for driving an output shaft which rotates a breakaway aluminum gate arm between a traffic obstructing position and a non-obstructing position and having extension portions formed on the ends of the rotor shaft of the permanent magnetic d.c. motor for receiving ratchet wrenches whereby the output shaft may be manually moved between the traffic obstructing position and the non-obstructing position.

Yet a further object of this invention is to provide a novel grade crossing gate assembly having a gate arm movable between a vertical and a horizontal position by a motorized operating mechanism or by manual operable means.

Still another object of this invention is to provide a novel traffic crossing gate mechanism including an output shaft power driven through a gear reduction train by an electric motor which has shaft extensions for receiving ratchet wrenches for manually moving the output shaft and also for receiving a torque measuring device.

Still a further object of this invention is to provide a crossing gate assembly having an elongated gate arm movable between a clear position and an obstructing position, a gate arm bracket including a breakaway connector for holding the elongated gate arm, a gate supporting means coupled to the gate arm bracket, a gate mechanism cooperatively associated with the gate supporting means, the gate mechanism including a motor and a gear train for rotating an output shaft wherein the elongated gate arm is moved between the clear and the obstructing position, the motor including shaft extension means for receiving a torque measuring device for determining the torque that is required for lifting the gate arm from the obstructing position for establishing the downward torque when the gate arm is allowed to freely move from the clear position to the obstructing position.

An additional object of this invention is to provide a new and improved railroad-highway crossing gate which is economical in cost, easy to install and maintain, simple in construction, reliable in operation, dependable in service and durable in use.

SUMMARY OF THE INVENTION

In accordance with the present invention, there is provided a railroad-highway grade crossing gate assembly including an elongated tubular aluminum gate arm, a breakaway connector coupling one end of the gate arm to a bracket member, a pair of counterweight balanced support arms having their free ends secured together by the bracket member and an operating mechanism having a main output shaft, the ends of which are attached to substantially the center of the respective support arms. The operating mechanism includes a permanent magnet d.c. motor which is mechanically coupled to the main output shaft through a speed reduction gear train. Thus, the main output shaft is rotated in one direction to raise the gate arm from a horizontal traffic obstructing position to a vertical clear or non-obstructing position and rotates in the other direction as the gate arm moves from vertical to the horizontal position. An electric brake or held clear device is cooperatively associated with a shaft extension portion of the shaft of the d.c. motor to hold the gate arm in its vertical clear position. A circuit controller appropriately energizes and deenergizes the d.c. motor and the electric brake and also controls the operation of the flashing lights and warning bell. If the crossing gate arm is broken and dislodged by excessive loading of ice or sleet or is run through by an automobile, the counterweight would normally tend to rapidly rotate the remaining bracket and supporting arms toward the clear position; however, the permanent magnet d.c. motor and a snubbing resistor function as a dynamic brake to slow down the rate of rotational movement to a relatively low angular velocity to prevent damage to the operating mechanism. Since it is extremely difficult and virtually impossible to initially mount and to subsequently replace a gate arm with the bracket and free ends of the supporting arms facing skyward, it is desirable to move and return the mechanism to a horizontal position. In the present invention, the mechanism is easily and quickly returned to the horizontal position by simply attaching a ratchet wrench and socket to each end of the shaft of the d.c. motor. The extremity of each end of the shaft which extends beyond the housing of the motor is formed with a square-headed portion for accommodating a four or eight-pointed socket or the like. One of the ratchets is used to turn the motor shaft in one given direction while the other ratchet holds and prevents the counterweight from rotating the supporting arms during the ratcheting stroke. When the support arms are returned to their horizontal position, the handle of the holding ratchet may be braced against the housing of the operating mechanism to lock the motor shaft in position. With the arms in the horizontal position, a single maintainer can pick up the lightweight aluminum gate arm and insert it into the channel member of the connector which is attached to the bracket member. A new shear bolt or pin is inserted into the aligned holes formed in the channel and arm, and then a nut and cotter pin lock the shear bolt in place. In practice, six snug bolts are hand tightened to remove any wobble or play between the gate arm and channel member, and then each of the bolts are locked in position by suitable locking nuts. Once the arm is replaced, the maintainer may remove the locking ratchet and the gate will remain in the horizontal obstructing position due to the counterbalancing or weight of the gate arm. The maintainer may now measure and adjust the lift torque in accordance with the recommendation or specification of the manufacturer. The maintainer simply places a torque wrench and an appropriate socket onto one of the square ends of the motor shaft, and when the gate arm begins to rise, the maintainer may observe the lift torque on the dial indicator on the torque wrench. If the lift torque needs to be increased or decreased, the maintainer may shift the counterweights further away or closer toward the axis of the main output shaft. After the appropriate lifting torque is obtained, the torque wrench is removed and the maintainer may electrically energize the permanent magnet d.c. motor to raise the gate arm to its vertical non-obstructing position. Again, the maintainer places the torque wrench onto the square end of the shaft of the motor for measuring the downward torque of the gate arm. The downward torque is measured by deenergizing the hold clear brake so that the gate arm falls freely under the influence of gravity and exerts a moment on the torque wrench which is readily observed on the dial indicator by the maintainer. Again, the torque may be adjusted by simply shifting the counterweights in the appropriate direction on the ends of the supporting arms. Thus, the replacement of a gate arm and the measurement of the torque may be accomplished by a single maintainer and without the need of a fish scale and the cumbersome ladder for climbing the pole.

DESCRIPTION OF THE DRAWINGS

The foregoing objects and other attendant features and advantages will be more readily apparent and appreciated as the subject invention becomes more clearly understood by reference to the following detailed description when considered in conjunction with the accompanying drawings wherein:

FIG. 3 is a side vertical sectional view of the operating mechanism taken along line III—III of FIG. 2.

DESCRIPTION OF THE PREFERRED EMBODIMENT

Figure 1:
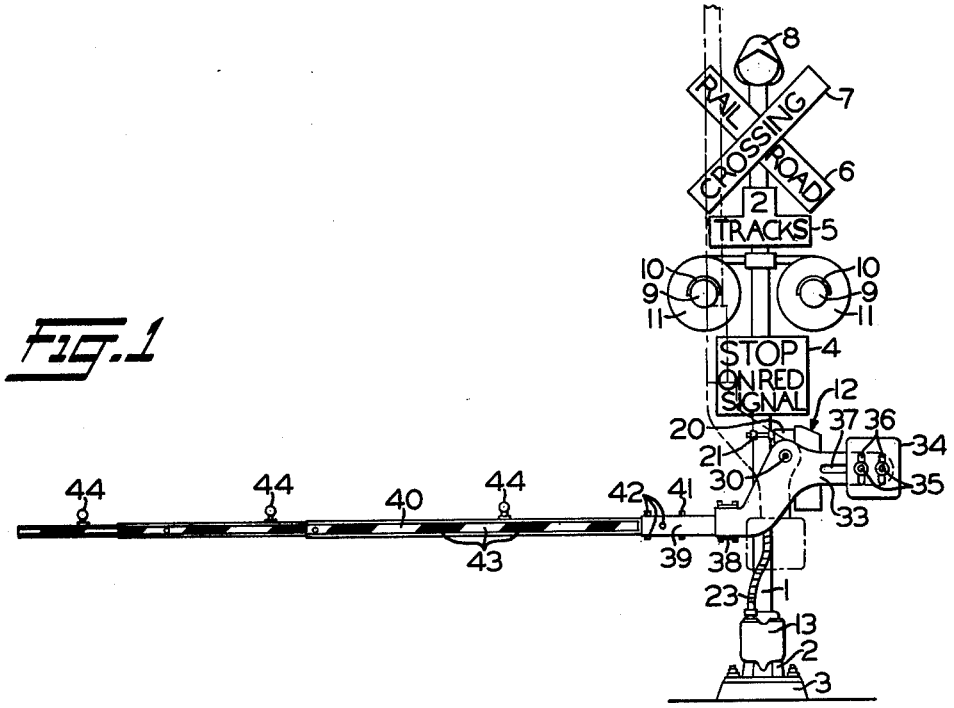
FIG. 1 is a side elevational view of the grade crossing gate assembly embodying the features and advantages of the present invention with the gate arm in the horizontal traffic obstructing position.

Referring now to the drawings and in particular to FIG. 1, there is shown a railroad-highway crossing gate assembly for installation at a grade crossing intersection. As shown, there is a mast or pole 1 having a base 2 which is securely fastened to a concrete foundation 3. The mast 1 supports and carries a "Stop On Red Signal" sign 4, a number of tracks guarded, in the present case a "2 Track" sign 5, cross arms 6 and 7 bearing the words "Railroad Crossing", a warning bell 8, flashing lights 9 which include hoods 10 and background discs 11. The mast 1 also supports and carries the operating mechanism 12 and the electrical junction box 13.

Figure 4:
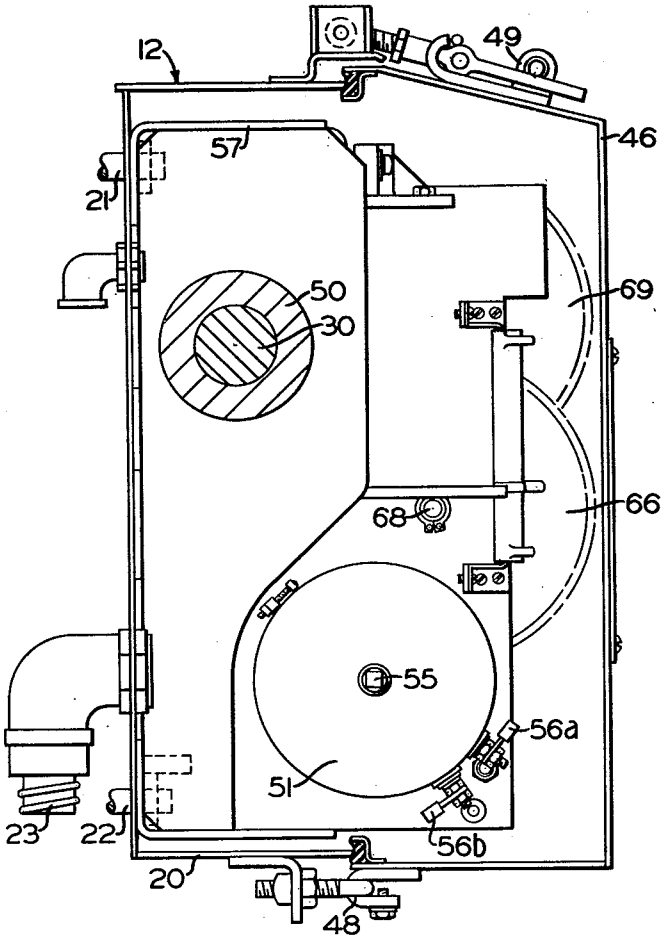
FIG. 4 is a side vertical sectional view of the operating mechanism taken along lines IV—IV of FIG. 2.
Figure 5:
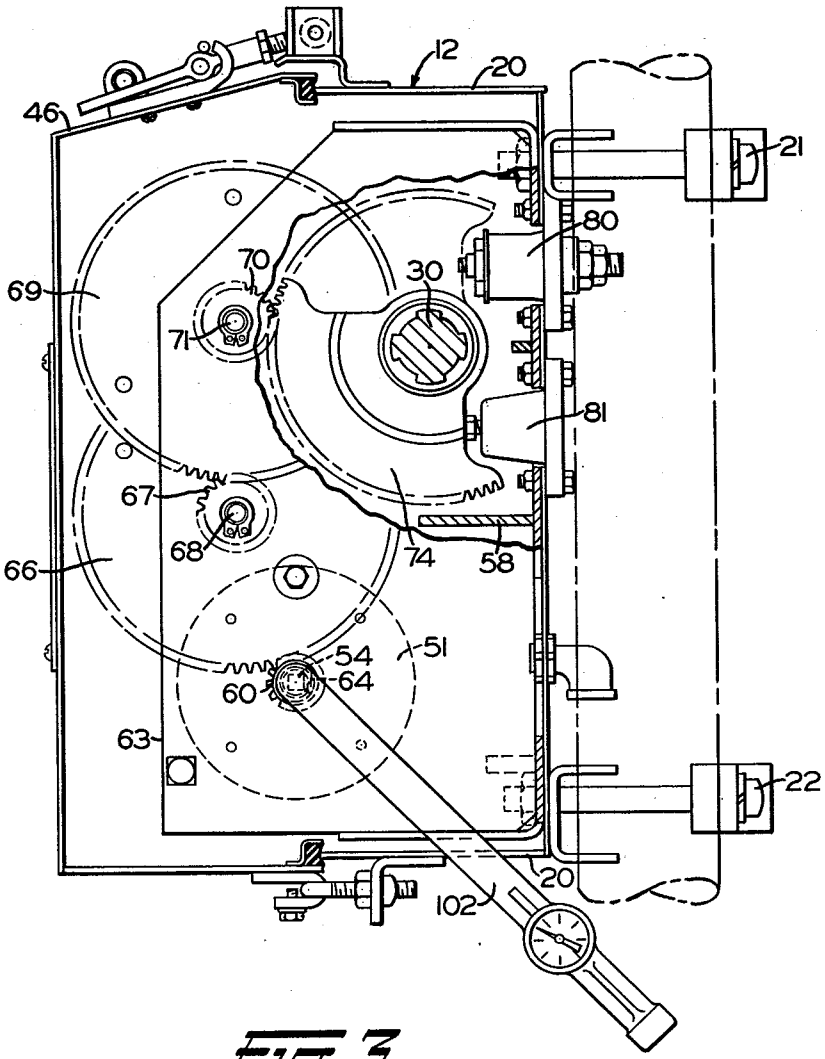

Now in viewing FIGS. 1, 3 and 4, it will be noted that the mechanism 12, comprises a suitable prefabricated sheet metal housing 20 which is attached to the mast 1 at an appropriate height or level above ground level by a pair of suitable clamps 21 and 22. The operating mechanism is connected to the junction box 13 via a flexible conduit 23 which supplies electrical power to operate the gate assembly. In viewing FIGS. 1 and 2, it will be noted that the terminal ends or outer extremities of a main output shaft 30 protrude out of the respective sides of the housing 20. The ends of the shaft include splined portions 31*a* and 31*b* which are adapted to receive internally splined sleeves 32*a* and 32*b* carried by a pair of gated arm supports 33*a* and 33*b*, respectively. Thus, the gate supports are attached to the operating mechanism and are securely held in position by appropriate washers and nuts (not characterized). The weight-carrying end of each of the support arms, which may be referred to as the rearward portion, are arranged to adjustably carry a counterweight 34, as shown in FIG. 1, which may be moved manually toward or away from the horizontal axis of the main shaft 30. As shown in FIG. 1, the counterweight 34 is suitably locked in the final adjusted position by a pair of lock bolts and nuts 35 which cooperate with the elongated slots 36 formed in the counterweight 35 and the elongated slot 37 formed in the rearward portions of arm support 33*b*. The support arms 33*a* and 33*b* are jointed together by a pair of metal plates of a supporting bracket 38 which span the distance between the forward portions of the arms and are bolted in place. A C-shaped channel connection member 39 has one end fixedly attached to the plates of the support bracket 38. The channel member 39 receives one end of an elongated tubular aluminum gate arm 40 which includes a breakaway feature in the form of a shear pin or bolt 41. The shear bolt 41 is preferably made of aluminum or other soft metal and has a shank portion which is formed with a pair of neck portions of reduced diameters. The bolt 41 has a head portion and a thread portion onto which is screwed a suitable locking nut and a through hole for receiving a cotter pin for locking purposes, (not characterized). The bolt 41 provides the sole connection between the gate arm 40 and channel member 39 and a number of snugging bolts, two of which are characterized by numeral 42 in FIG. 1, taking up the slack, wobble and play which exists between the arm 40 and channel member 39. The aluminum arm 40 is provided with alternate stripes 43 of different colors of suitable retro-reflective material which reflects the lights of oncoming vehicles back to the driver. Further, the gate arm 40 is provided with three electrical lamps or lights 44, one of which is continuously illuminated while the other two are intermittently flashed to warn oncoming traffic of an approaching train.

Figure 2:
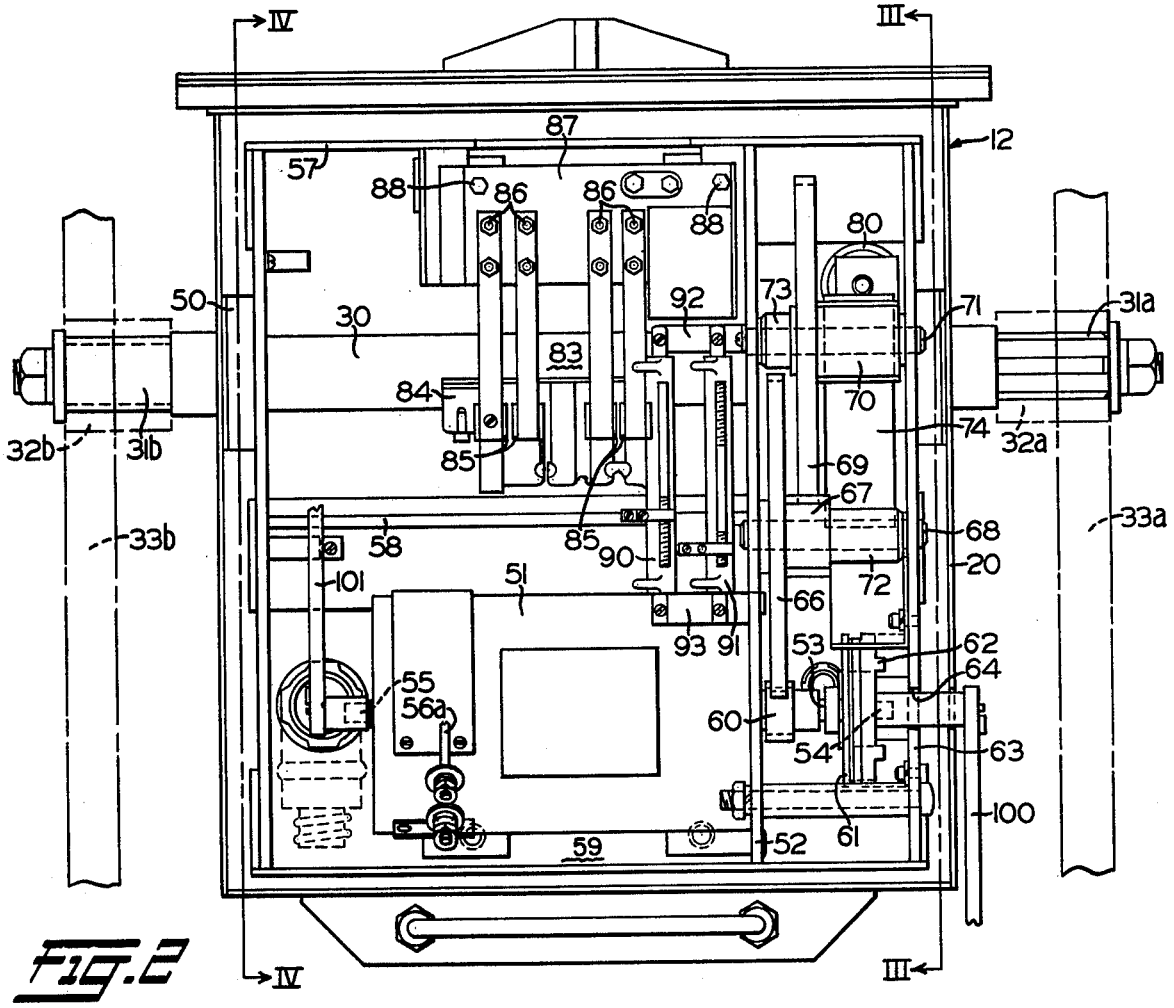
FIG. 2 is an enlarged front elevation view of the operating mechanism with the cover removed from the housing.

Turning now more particularly to the details of the gate arm operating mechanism 12 as shown in FIGS. 2, 3 and 4 of the drawings, it will be seen that the housing 20 is provided with a rubber gasketed weldment type of metal cover 46. The metal cover is hinged to the bottom of casing 20 as shown at 48 and may be latched and locked thereto by a pivotal hasp and eyelet arrangement as shown at 49, so that the cover 46 may be opened and swung downwardly against the mast 1 to expose the internal parts or components of the mechanism.

The main output shaft 30 is mounted transversely and is journaled in suitable bearings 50, such as sealed ball or roller bearings, which are carried one in each of the side walls of housing 20. As previously mentioned, the ends of the shaft 30 extend through bearings 50 to the outside of housing 20 for attachment to the gate support arms 32*a* and 32*b*. The main output shaft and the highway crossing gate arm 40 are rotated by means of an electric motor 51 through a suitable gear train arrangement which provides a speed reduction ratio of, for example, 115 to 1 or the like, as required in order to accomplish and appropriate angular rotation of the gate arm in its movement between a horizontal obstructing position and a vertical clear position. It will be understood that motor 51 is mounted to the internal vertical wall 52 of a support casing 59 by four through bolts which are held thereto by suitable nuts and washers (not shown). The right-handed end of rotor shaft 53 of motor 51 is formed with a square-shaped extremity 54, the purpose of which will be described in detail hereinafter. Similarly, as shown in FIGS. 2 and 4, the left-handed end of motor shaft 53 extends beyond the end of the motor housing and is formed with a square-shaped extremity 55, the purpose of which will be described hereinafter. In practice, the motor 51 is a permanent magnet d.c. voltage machine which is powered by a suitable power supply, such as, a 12 volt d.c. potential source, which is connectable to the respective terminals of motor 51 via leads 56*a* and 56*b*. The use of a permanent magnet d.c. motor not only provides a dynamic braking effect during the free falling portion of the angular rotation of the gate arm in moving from its vertical non-obstructing position to its horizontal traffic position but also results in the added advantage of using a braking action to occur if and when the gate arm 40 is broken or released from channel member 39 due to a run-through by a motor vehicle or the like and thereby prevents the counterweight 34 from rapidly swinging the support arms 33*a* and 33*b* about the pivot shaft 30. This braking effect prevents damage to the operating mechanisms and precludes the possibility of severe injury to passersby in the immediate vicinity of the rotating support arms.

As shown in FIGS. 2 and 3, the right-handed extension of shaft 53 carries a pinion gear 60 which is driven by the motor 51. It will also be noted that an armature member 61 of an electromagnet brake device 62 is carried by the shaft extension 53. An electromagnet or stator 62 of the braking device is fixedly mounted to the outside vertical wall 63 of casing 59 so that the brake operates as a hold clear device when the electromagnet 62 is energized. It will be seen that an access hole or aperture 64 is formed in outside wall 63 to allow for insertion of a given tool or wrench, as will be described hereinafter. The pinion gear 60 meshes with and drives the first reduction gear 66 and its associated integral pinion gear 67 which is rotatably mounted on shaft 68. Likewise, the pinion gear 67 meshes with and drives the second reduction gear 69 and its associated integral pinion gear 70 which are rotatably mounted on shaft 71. The shafts 68 and 71 are held in position against rotational and transverse movement by set screws or the like (not shown), and suitable spacing bushing 72 and 73, respectively, position the gears 66, 67 and 69, 70 on the shafts 68 and 71.

The pinion gear 70 meshes with and drives a sector gear 74 which is fixedly mounted on the main output shaft 30 by means of a splined portion and suitable split retaining rings (not shown). Thus, the sector gear 74 provides a means for rotating the output shaft 30, arms 33*a* and 33*b*, bracket 38, connector 39 and, in turn, moving the highway crossing gate arm 40 between its two extreme positions. Since the gate arm 40, shaft 30 and sector gear 74 normally rotate through an arc of approximately 90°, it is advisable to provide stops 80 and 81 to limit the movement in both directions. The stops 80 and 81 function as resilient bumpers and are positioned within the mechanism casing 20 to act on the respective ends of sector gear 74 to limit its angular movement in either direction. In practice, each of the stops includes an adjustable stud retained bumper which is housed in a cylindrical well which is bolted to the back wall of casing 20. In operation, the resilient bumper stops provide a cushioning means for arresting the final movements of the gate arm and associated operating mechanism in both directions as each side or end comes to bear against the ends of the retaining studs as shown in the solid and phantom lines in FIG. 3.

The gate operating mechanism 12 is also provided with a conventional circuit controller 83 comprising a plurality of cam operated contact fingers to open and close respective circuits of the motor 51, lights 9 and 44, bell 8, brake coil 62, etc. at the appropriate times as the gate arm 40 moves between its non-obstructing and obstructing positions. The commutator 84 is made up of quadrant-shaped aluminum casting which is fastened to the main output shaft 30 and, consequently, also rotates through an arc of approximately 90°. The peripheral surface of commutator 84 is provided with a plurality of raised cams 85 which cooperate with contact fingers 86 to open or close the various circuits of the crossing gate at various degrees of the rotary movement of the commutator. The contact fingers are carried by an insulative terminal board 87 which in turn is securely mounted by suitable brackets to the top wall 57 of casing 59, by means of bolts 88. As shown in FIG. 2, a pair of adjustable resistors 90 and 91 are fastened to upper and lower L-shaped brackets 92 and 93 which are suitably mounted to the intermediate wall 52 of casing 59. The resistor 90 functions as a snubbing resistance element which draws the motor current in the final 45° of descent as the gate arm travels from the vertical non-obstructing position to its horizontal obstructing position. The resistor 90 provides a direct shunt across the motor 51 to increase the braking action and to bring the gate arm 40 to a cushioned stop against bumper 81. Thus, the snubbing resistor 90 is employed to prevent the gate arm counterweight from suddenly dropping and thereby precluding damage to the operating mechanism in the case where the arm 40 is broken or dislodged while it is in its horizontal obstructing position. That is, the permanent magnetic d.c. motor discharges its inductively generated current through snubbing resistor 91 which causes a braking action to slown down the angular rotation due to the unbalancing effect of the counterweight. Thus, the operating mechanism is brought to rest gradually and smoothly under the dynamic braking effect of the permanent magnet d.c. motor so that no damage occurs due to the loss of the gate arm 40. An adjustable current limiting resistor 91 is connected in series with the motor 51 when it is energized to vary the speed and movement of the gate arm 40.

In operation, it will be appreciated that the gate arm 40 is normally held in the vertical non-obstructing or clear 90° position by a hold clear circuit which energizes the electromagnetic brake and causes the coil 62 to attract armature 61 and thereby locks the motor shaft and, in turn, the gate arm 40 in place. Now, when a train enters the highway protection detection zone, the electromagnet coil 62 will be deenergized and the d.c. motor 51 will be energized so that the gate arm is power driven toward its horizontal obstruction position. At approximately 45°, power is removed from the motor and gravity continues to drive the gate arm 40 toward the 0° position with the d.c. motor 51 now functioning as a generator to discharge the current through snubbing resistor 90. The descending time of the gate arm may be varied by adjusting the value of the snubbing resistor 90. Simultaneous sounding of the warning bell 8 and flashing or lighting of the signal lamps 9 and 44 occurs with the energization of the d.c. motor 51 so that oncoming traffic and pedestrians are forewarned of the oncoming train.

After the train has cleared the detection zone, the gate arm 40 will be returned to its non-obstructing position by energization of the motor up-circuit. When the gate arm approaches the 90° clear position, the motor is deenergized while the hold clear circuit energizes the electromagnetic brake coil 162 and again the gate is positively locked in place. The bell 8 and lamps 9 and 44 are deenergized when the train clears the detection zone. Thus, the highway crossing gate assembly will continue to be operated by approaching trains to protect the general public against injury and to prevent damage to motor vehicles and trains.

Let us now assume that an approaching train again causes the lightweight aluminum gate arm 40 to be lower to its horizontal traffic blocking position and that a motor vehicle becomes entrapped or is unable to stop at the highway crossing. In either case, the vehicle will strike the gate arm 40 at some point along its length, and the force of the impact will cause the shearing of shear pin 41. Thus, the butt end of arm 40 will pop out of the channel member 39 and the entire gate arm 40 will freely fall to the ground. The loss of the gate arm 40 will immediately cause the counterweight gate arm supports 33*a* and 33*b* to begin to rotate under the influence of gravity in a clockwise direction as viewed in FIG. 1. The unbalanced gate arm supports would tend to suddenly swing about pivot shaft 30; however, the permanent magnet d.c. motor will function as a generator to produce current which flows through snubbing resistor 91 causing a braking action to counteract the force of gravity. Thus, the gate arm supports will slowly rotate in a clockwise direction without resulting in any damage to the operating mechanism 12.

In order to again provide protection to the general public, is necessary to restore the highway crossing gate assembly to its operational condition by replacing the gate arm 40. Generally, the fallen gate arm will sustain little, if any, damage so that a maintainer may simply reposition the butt end into the channel member 39 and insert a new shear bolt 41. However, since the channel member is pointing skyward, a maintainer initially must lower the gate arm supports to their horizontal 0° position to facilitate a one man replacement of the tubular aluminum gate arm 40. In order to lower the gate arm supports, a maintainer simply takes a pair of ratchet wrenches 100, 101 and appropriate sockets and places them on the respective square-shaped ends 54 and 55 of the extension portion of the shaft 53 of motor 51, as shown in phantom in FIG. 2. The ratchet wrench 100 provides the turn torque to the motor shaft 53 while the ratchet wrench 101 is braced against the front of the ledge or shelf 58 of casing 54 and acts as a locking means to prevent reversal movement during the ratcheting return stroke of ratchet wrench 100. The rotational movement on the motor shaft extention 54 is transmitted through the gear train to output shaft 30 and, in turn, to the gate arm supports 33*a* and 33*b*. After the gate arm supports are returned to their horizontal position, the ratchet 101 will hold or retain the entire mechanism in 0° position so that a maintainer can readily insert and position the butt end of the lightweight gate arm 40 into the horizontal extending channel member 39, and after aligning the holes he will insert a new shear pin 41 and will screw on a locking nut and will insert a cotter pin into the end of pin 41. Thereafter, the maintainer will finger tighten the six snug bolts 42 to take up any play and to remove any wobble that may exist between the gate arm 40 and channel member 39. Once the gate arm 40 is in place, the ratchet wrenches 100 and 101 may be removed and the weight of the arm will hold the mechanism in its horizontal position.

In order to insure proper operation of the highway crossing gate assembly, it is advisable to measure the lifting torque required of the motor 51 to pick up the gate arm and also the downward torque which freely returns the gate arm from its vertical to its horizontal position under the influence of gravity. With the gate arm in its horizontal position, a maintainer simply places a torque wrench 102 and an appropriate socket onto the square end 54, as shown in FIG. 3, and exerts a turn movement on the torque wrench handle until the gate arm 40 begins to lift. The maintainer observes the torque of the dial of the torque wrench 102, and if the torque is not within the suggested limits of the manufacturer, he merely shifts the counterweights 34 in the appropriate direction, to or fro. on supports 33*a* and 33*b*. Next, he energizes the motor 51 to lift the gate arm 40 to its vertical non-obstructing position, and then he deenergizes the coil 62 of the electromagnetic brake. The gate arm will begin its free fall so that he may again observe the downward torque on the dial of the torque wrench 102, and then he may not or may readjust the counterweights 34 to begin the torque within the tolerances suggested by the manufacturer.

Thus, it will be seen that the present invention results in an improved railroad-highway crossing gate assembly which is initially facile to install in situ and which also is easily maintained and is normally undamaged when a motor vehicle runs through and dislodges the gate arm.

It will be appreciated that various changes, modifications and alterations may be made by persons skilled in the art without departing from the spirit and scope of the present invention. For example, instead of having the square-shaped ends 54 and 55, it is apparent that hexagon, octagon, or the like headed ends may be used in practicing the present invention. Further, it will be appreciated in place of a wrench receiving portion being formed on each end of shaft 53, a dual receiving portion, such as, a hexagon and a square end portion, may be located on one end of the shaft 53 of motor 51. That is, only one end of shaft 53, such as, end 54, may have an enlarged intermediate hexagon portion for receiving a box-wrench type of ratchet and also may have a slightly smaller terminal square-headed portion for receiving a socket type of ratchet whereby the gate arm 40 may be ratcheted between its two extreme positions. Further, it will be understood that either one or both of ratchet wrenches may be replaced by a conventional box or open-end wrench, or the like, in rotating the mechanism between its vertical and horizontal positions. Thus, it is understood that all changes equivalents and modifications producing the same results in substantially way with substantially the same features as this invention are herein meant to be included in the appended claims.

Having now described the invention, what I claim as new and desire to secure by Letters Patent, is:

1. A crossing gate assembly comprising, (a) an elongated gate arm movable between a clear position and an obstructing position, (b) a gate arm bracket including a breakaway connector for holding said elongated gate arm, (c) a gate support means coupled with said gate arm bracket, (d) a gate mechanism cooperatively associated with said gate supporting means, said gate mechanism includes a motor and a gear train for rotating an output shaft wherein said elongated gate arm is moved between said clear and said obstructing position, said motor including shaft extension means for receiving a torque measuring device for determining the torque that is required to lift said gate arm from said obstructing position and for establishing the downward torque when said gate arm is allowed to freely move from said clear position to said obstructing position.

2. The crossing gate assembly as defined in claim 1, wherein said motor is a permanent magnet d.c. motor which functions as a braking means when said motor is deenergized.

3. The crossing gate assembly as defined in claim 1, wherein said shaft extension means includes a receiving portion for accepting a ratchet type of crank device for allowing said output shaft to be manually rotated to permit said gate arm bracket to be moved to said obstructing position so that a damaged or detached gate arm may be quickly and easily replaced.

4. The crossing gate assembly as defined in claim 1, wherein said shaft extension means is a first receiving portion formed on one end of the motor shaft for accommodating a first ratchet wrench and a second receiving portion formed on the other end of the motor shaft for accommodating a second ratchet wrench.

5. The crossing gate assembly as defined in claim 1, wherein adjustable counterweights are carried by the gate supporting means for varying the torque.

6. The crossing gate assembly as defined in claim 1, wherein said torque measuring device is a torque wrench and a socket for fitting on said shaft extension means.

7. The crossing gate assembly as defined in claim 1, wherein said shaft extension means is formed with a socket receiving portion for accommodating a torque wrench as well as a ratchet wrench.

8. The crossing gate assembly as defined in claim 1, wherein an electric brake holds the gate arm in said clear position.

9. A mechanism for a highway crossing gate comprising a housing, a d.c. permanent magnet motor mounted within said housing, a gear train driven by said d.c. permanent magnet motor, an output shaft driven by said gear train and movable between a first and a second extreme position, a circuit controller for energizing and deenergizing said d.c. permanent magnet motor as said output shaft rotates between said first and said second positions, an electric brake cooperatively associated with the shaft of said permanent magnet d.c. motor for holding said output shaft in said first extreme position, and said shaft of said d.c. permanent magnet motor having at least one extended end portion either for receiving torque wrench means for measuring the torque or for receiving wrench means for manually moving said output shaft between said first and said second positions.

10. A mechanism for a highway crossing gate as defined in claim 9, wherein said permanent magnet d.c. motor operates as a retarding means for controlling the rotational speed of said output shaft.

11. A mechanism for a highway crossing gate comprising a housing, a d.c. permanent magnet motor mounted within said housing, a gear train driven by said d.c. permanent magnet motor, an output shaft driven by said gear train and movable between a first and a second extreme position, a circuit controller for energizing and deenergizing said d.c. permanent magnet motor as said output shaft rotates between said first and said second positions, an electric brake cooperatively associated with the shaft of said permanent magnet d.c. motor for holding said output shaft in said first extreme position, and said shaft of said d.c. permanent magnet motor having at least one extended end portion for receiving wrench means for manually moving said output shaft between said first and said second positions.

12. The mechanism as defined in claim 11, wherein said extended end portion is formed with a bolt-like head.

13. A mechanism for a highway crossing gate comprising a housing, a d.c. permanent magnet motor mounted within said housing, a gear train driven by said d.c. permanent magnet motor, an output shaft driven by said gear train and movable between a first and a second extreme position, a circuit controller for energizing and deenergizing said d.c. permanent magnet motor as said output shaft rotates between said first and said second positions, an electric brake cooperatively associated with the shaft of said permanent magnet d.c. motor for holding said output shaft in said first extreme position, and said shaft of said d.c. permanent magnet motor having at least one extended end portion for receiving a torque wrench for measuring the lifting and the downward torques.

14. A crossing gate assembly comprising, (a) an elongated gate arm movable between a clear position and an obstructing position, (b) a gate arm bracket including a breakaway connector for holding said elongated gate arm, (c) a gate support means coupled with said gate arm bracket, (d) a gate mechanism cooperatively associated with said gate supporting means, said gate mechanism includes a motor and a gear train for rotating an output shaft wherein said elongated gate arm is moved between said clear and said obstructing position, and means for receiving wrench means for measuring the torque and for moving said gate arm between said obstructing position and said clear position.

* * * * *